US007018967B2

(12) United States Patent
Hubig et al.

(10) Patent No.: US 7,018,967 B2
(45) Date of Patent: Mar. 28, 2006

(54) PRESPOTTING TREATMENT EMPLOYING SINGLET OXYGEN

(75) Inventors: Stephan M. Hubig, Maplewood, MN (US); Kristopher R. Grymonpré, Indianapolis, IN (US); Christopher James Uecker, Eden Prairie, MN (US)

(73) Assignee: Ecolab Inc., St. Paul, MN (US)

( * ) Notice: Subject to any disclaimer, the term of this patent is extended or adjusted under 35 U.S.C. 154(b) by 409 days.

(21) Appl. No.: 10/389,167

(22) Filed: Mar. 12, 2003

(65) Prior Publication Data

US 2004/0180802 A1 Sep. 16, 2004

(51) Int. Cl.
*C11D 7/10* (2006.01)
*C11D 7/18* (2006.01)
*C11D 7/54* (2006.01)

(52) U.S. Cl. ..... 510/284; 510/283; 510/303; 510/309; 510/372; 510/378; 510/508

(58) Field of Classification Search ..... None
See application file for complete search history.

(56) References Cited

U.S. PATENT DOCUMENTS

| | | | | |
|---|---|---|---|---|
| 3,819,524 | A | 6/1974 | Schubert et al. | |
| 5,679,661 | A | 10/1997 | Willey | |
| 5,795,854 | A | 8/1998 | Angell et al. | |
| 5,891,838 | A | 4/1999 | Angell et al. | |
| 5,904,734 | A | 5/1999 | Friberg et al. | |
| 5,916,481 | A | 6/1999 | Willey | |
| 6,262,005 | B1 | 7/2001 | Willey et al. | |
| 6,451,752 | B1 * | 9/2002 | Delroisse et al. | 510/370 |
| 6,844,305 | B1 * | 1/2005 | Depoot et al. | 510/372 |
| 2002/0157189 | A1 * | 10/2002 | Wang et al. | 8/111 |

FOREIGN PATENT DOCUMENTS

| | | |
|---|---|---|
| EP | 0 845 524 A2 | 6/1998 |
| JP | 5-025498 | 2/1993 |
| JP | 6-041593 | 2/1994 |
| JP | 10-298591 | 11/1998 |

OTHER PUBLICATIONS

Aubry, J. M. and Bouttemy, S., "Preparative oxidation of organic compounds in microemulsions with singlet oxygen generated chemically by the sodium molybdate/hydrogen peroxide system", *JACS, 119*, 5286-5294 (1997).
Gorman, A. A. and Rodgers, M. A. J., "Lifetime and reactivity of singlet oxygen in an aqueous micellar system: a pulsed nitrogen laser study", *Chem Phys. Lett., 55*, 52-54 (1978).

* cited by examiner

*Primary Examiner*—Gregory R. Del Cotto
(74) *Attorney, Agent, or Firm*—IPLM Group, P.A.

(57) ABSTRACT

Enhanced cleaning can be obtained by applying primarily to a stained region of a washable soft substrate a prespotting composition that contains at least one molybdate and which can generate singlet oxygen in situ in the presence of a peroxide, optionally applying to the substrate a prespotting composition that contains at least one peroxide, and rinsing, laundering or otherwise cleaning the substrate, using a peroxygen-containing built detergent to clean the substrate if a prespotting composition containing peroxide has not been applied to the substrate. Preferred embodiments of the method can provide stain removal comparable to that obtained using chlorine bleach but with better color safety. The method preferably is performed using a prespotting kit containing a molybdate solution, a peroxide solution and instructions for applying the solutions primarily to a stained region of a washable soft substrate, thereby providing a treated article whose stained region has preferentially absorbed thereon an aqueous singlet oxygen-generating mixture comprising peroxide and molybdate.

28 Claims, No Drawings

PRESPOTTING TREATMENT EMPLOYING SINGLET OXYGEN

This invention relates to prespotting treatments for use on fabric, leather, carpet and other stain-bearing soft substrates.

BACKGROUND

Singlet oxygen is an activated form of molecular oxygen. Various compositions that generate singlet oxygen in the presence of light and oxygen (and in some cases in the presence of a photosensitizer) have been used as photobleaches or as bleach activators. References describing such compositions include U.S. Pat. Nos. 5,679,661, 5,795,854, 5,891,838, 5,904,734, 5,916,481 and 6,262,005, European Patent Application No. EP 0 845 524 A2 and Japanese Published Patent Application (Kokai) No. JP 6-041593. Other references relating to singlet oxygen include Aubry, J. M. and Bouttemy, S., "Preparative oxidation of organic compounds in microemulsions with singlet oxygen generated chemically by the sodium molybdate/hydrogen peroxide system", *JACS,* 119, 5286–5294 (1997) and Gorman, A. A. and Rodgers, M. A. J., "Lifetime and reactivity of singlet oxygen in an aqueous micellar system: a pulsed nitrogen laser study", *Chem Phys. Lett.,* 55, 52–54 (1978).

SUMMARY OF INVENTION

When added to or formed in a bleaching bath, singlet oxygen can provide enhanced cleaning capability. However, singlet oxygen's relatively short half-life limits its effectiveness. Enhanced cleaning performance can be obtained via a method comprising applying primarily to a stained region of a washable soft substrate a spot treatment ("prespotting") composition that contains at least one molybdate and which can generate singlet oxygen in situ in the presence of a peroxide, optionally applying to the substrate a prespotting composition that contains at least one peroxide, and rinsing, laundering or otherwise cleaning the substrate, using a peroxygen-containing built detergent if a prespotting composition containing peroxide has not been applied to the substrate. Especially preferred cleaning is obtained by a method comprising applying primarily to a stained region of the substrate a first aqueous molybdate-containing prespotting composition and a second aqueous peroxide-containing prespotting composition and then rinsing, laundering or otherwise cleaning the substrate.

The present invention also provides a prespotting kit comprising a first solution comprising at least one molybdate, a second solution comprising at least one peroxide and instructions for applying the solutions primarily to a stained region of a washable soft substrate.

The present invention also provides a treated article comprising a washable soft substrate having a stained region, the stained region having preferentially absorbed thereon an aqueous singlet oxygen-generating mixture comprising peroxide and more than 0.1 wt. % molybdate.

The prespotting compositions used in the invention tend to be strongly colored and thus ordinarily might be contraindicated for use on fabric, leather, carpet and other stainable soft substrates. Despite such initial coloration, these prespotting compositions are relatively color-safe and can provide very satisfactory stain removal. The method and kit of the invention can provide more effective stain removal than is obtained by using a molybdate and peroxide in a bleaching bath (as in Japanese Published Patent Application (Kokai) No. JP 6-041593). Especially preferred embodiments of the method and kit of the invention can provide more effective stain removal and better color safety than is obtained using chlorine bleach. The method, kit and treated articles of the invention do not require heavy metal ingredients such as are employed in bleaching systems based on tungstates and peroxides (as in U.S. Pat. No. 5,904,734).

DETAILED DESCRIPTION

As used in this invention, the term "cleaning" refers to the reduction in or removal of visible stains from a substrate. The term "stained region" refers to a visibly-stained portion of a substrate, but need not include all such visibly-stained portions. The term "applied primarily to a stained region" refers to the application of a prespotting composition at a greater add-on weight to at least one stained region than to at least one unstained region. The term "preferentially absorbed thereon" refers the absorption of a prespotting composition to a greater extent in at least one stained region than in at least one unstained region. The term "molybdate" refers to refers to a salt of molybdic acid or a compound or compounds that release a salt of molybdic acid in aqueous solution. The term "peroxide" refers to hydrogen peroxide or to a compound or compounds that release hydrogen peroxide in aqueous solution. The term "singlet oxygen-containing" when used in respect to a composition refers to a liquid or solid that contains singlet oxygen in an amount effective for cleaning. The term "singlet oxygen-generating" when used in respect to a composition refers to one or more liquids or solids that initially do not contain singlet oxygen in an amount effective for cleaning but that when mixed, when allowed to stand for a suitable period of time, or when subjected to a suitable internal or external activating agent or activating energy will provide singlet oxygen in an amount effective for cleaning. The term "in situ" refers to the generation of singlet oxygen while a prespotting composition is in contact with a stained region of a substrate. The term "located outside a laundering apparatus" when used in respect to a substrate refers to a substrate that is not inside a washing machine, laundry tub or other such cleaning device.

A variety of molybdates can be employed in the invention including alkali or ammonium salts of molybdic acid such as sodium, potassium, lithium or ammonium molybdate or mixtures thereof. Sodium, potassium and ammonium molybdates are preferred with sodium molybdate being especially preferred. A variety of peroxides can also be employed in the invention including hydrogen peroxide, percarbonates such as sodium percarbonate, perborates such as sodium perborate, hydrogen peroxide adducts or pyrophosphates, citrates, sodium sulfate, urea and sodium silicate, and mixtures thereof. Hydrogen peroxide is an especially preferred peroxide.

The prespotting composition can be packaged as a one-part liquid, one-part solid or as a multi-part (e.g., two-part) composition in which two parts are liquids, two parts are solids, or one part is a liquid and the other part is a solid. For example, the prespotting composition can be in the form of a one-part liquid or solid mixture containing molybdate but not peroxide, in which case the prespotting composition is applied primarily to a stained region and later washed using a peroxygen-containing built detergent. The prespotting composition can also be in the form of a one-part liquid or solid mixture containing both molybdate and peroxide. These one-part mixtures or molybdate and peroxide typically will have a limited shelf life unless the molybdate and peroxide are separated until just before use, e.g., by encapsulating one or both of the molybdate and peroxide to prevent their premature reaction with one another. Preferably both a molybdate and peroxide are applied primarily to the stained region by applying separate first and second prespotting compositions one of which contains at least one molybdate and the other of which contains at least one peroxide. If desired, the prespotting composition can be separated into additional parts, e.g., into three parts, with a first part containing at least one molybdate, a second part containing at least one peroxide and a third part containing water or other desired ingredients. When a prespotting composition or a part thereof is a liquid, the liquid can be aqueous (that is, primarily containing water) or non-aqueous (that is, primarily containing a liquid or liquids other than water). Aqueous prespotting compositions are preferred. When the prespotting composition or a part thereof is a solid, the solid can have a powdered form or if desired can be shaped or molded into a suitable pellet, block or other convenient shape, e.g., for use in a dispenser. Typically such solid compositions will be water-soluble and will be dissolved using supplied water prior to or at the time of use. Aqueous two-part prespotting compositions are especially preferred for use in the invention.

If a peroxide-containing prespotting composition is not applied to the substrate then the substrate preferably is cleaned using a peroxygen-containing built detergent. Suitable peroxide-containing built detergents (also sometimes referred to as detergent plus bleach formulations) will be familiar to those skilled in the art, e.g., detergents containing sodium perborate and sodium percarbonate.

At the time of or just prior to application to a substrate, the prespotting composition or compositions preferably contain about 1 to about 20 wt. % molybdate (preferably as an aqueous solution) based on the total weight of all prespotting composition ingredients applied to the stained region. The prespotting composition or compositions also preferably contain about 1 to about 35 wt. % peroxide (also preferably as an aqueous solution) based on the total weight of all prespotting composition ingredients applied to the stained region. More preferably the prespotting composition or compositions contain about 1 to about 10 wt. % molybdate and about 2 to about 35 wt. % peroxide. In general improved cleaning is obtained at higher molybdate and peroxide concentrations. The molar ratio of molybdate to peroxide can vary over a wide range, e.g., from about 2:1 to about 1:35, more preferably from about 1:5 to about 1:35.

The prespotting composition preferably is applied in an amount sufficient to achieve the desired degree of cleaning. This amount will depend in part on the nature of the stain and the nature of the substrate. As a general guide for use when applying one or more aqueous prespotting compositions containing molybdate and peroxide, a solution or solutions containing at least about 1 wt. % molybdate and at least about 2 wt. % peroxide (35% active) should be applied primarily to a stained region of a target substrate in an amount sufficient to saturate the stained region. More preferably a solution or solutions containing at least about 2 wt. % molybdate and at least about 5 wt. % peroxide should be applied to the stained region.

The prespotting compositions of the invention optionally can contain at least one surfactant. A variety of surfactants can be employed, including anionic, cationic, nonionic, amphoteric or zwitterionic surfactants such as alkyl benzene sulfonates, alkyl sulfates, unsaturated sulfates, alkyl alkoxy sulfates, alkyl alkoxy carboxylates, glycerol ethers, alkyl polyglycosides and their corresponding sulfated polyglycosides, alpha-sulfonated fatty acid esters, alkyl ethoxylates, alkyl phenol alkoxylates, betaines, sulfobetaines, N-alkyl polyhydroxy fatty acid amides, N-alkoxy polyhydroxy fatty acid amides, other surfactants that will be familiar to those skilled in the art, and mixtures thereof. Compositions containing linear alkyl ethoxylate surfactants are especially preferred. Preferably the prespotting composition or compositions contain about 0.01 to about 2 wt. %, more preferably about 0.2 to about 1 wt. % surfactant based on the total weight of the composition.

Those skilled in the art will appreciate that the prespotting composition or compositions used in the invention can include a variety of other optional adjuvants. For example, the prespotting compositions can contain detergents, builders, bleaches, antimicrobial agents, buffers or pH modifiers, chelating or complexing agents, corrosion inhibitors, electrolytes, colorants, scents, foam inhibitors or foam generators, viscosity modifiers, nonaqueous solvents, coating aids and antistatic agents. The amounts and types of such adjuvants will be apparent to those skilled in the art.

The prespotting composition or compositions can be applied to a wide variety of soft substrates including fabrics (e.g., of cotton, wool or synthetics), knits, nonwovens, carpets, leathers, felts, and microporous films. The substrates can be fixed in place (e.g., carpets or automotive interior trim) or portable (e.g, clothing, drapes, upholstery, towels, wipes or rags).

Application of the prespotting composition or compositions can be carried out using any suitable technique including spraying; wiping; brushing; drip coating; roll coating; a water-soluble patch, paste or gel containing molybdate and optionally containing peroxide; and other methods for application of a thin film. Spray application using a pair of spray dispensers or one dispenser capable of dispensing two compositions (e.g., delivered from separate chambers containing molybdate or peroxide and mixed in a spray head) is especially preferred. It is also preferred to soak the substrate in a molybdate solution followed by spraying a peroxide solution onto the substrate, or to use a water-soluble patch made of polyvinyl alcohol or other suitable soluble carrier and molybdate that will dissolve when exposed to water and a peroxygen-containing built detergent.

Although if desired the entire substrate can be treated with the prespotting composition or compositions, the prespotting composition or compositions preferably are applied primarily to one or more visibly stained regions of the substrate and are preferentially absorbed by such stained regions. The composition or compositions typically will be applied to a soft substrate located outside a laundering apparatus, e.g., on a spotting table in a commercial cleaning operation. If desired the stained substrate can be placed in a laundering apparatus and treated with the prespotting composition or compositions prior to the start of a wash cycle. Following treatment, the prespotting composition preferably is permitted to remain on the substrate for a period of time, e.g., for about 10 seconds to about 24 hours, more preferably for about 1 minute to about 60 minutes, and most preferably for about one minute to about 10 minutes. If desired the prespotting composition or compositions can be allowed to or forced to dry, e.g., using ambient or forced air. The prespotting composition or compositions can be rinsed from the treated substrate or removed by laundering. Laundering using conventional detergents and laundering conditions is a preferred removal technique.

Aqueous prespotting compositions based on sodium molybdate and hydrogen peroxide typically have an orange-red coloration and thus might normally be regarded as undesirable for application to a stained soft substrate. However, this coloration is believed to represent one or more water-soluble species having a low staining potential, and may serve as an indicator that singlet oxygen generation is taking place. The color readily disappears after a subsequent wash cycle.

The invention is further illustrated in the following non-limiting examples, in which all parts and percentages are by weight unless otherwise indicated.

EXAMPLE 1

Stain Removal Followed by Rinsing Without Wash Cycle

Prespotting compositions of the invention were applied to three different fabric test swatches. The first swatch was Eidgenössische Materialprüfungsanstalt No. 115 bleach test cloth ("EMPA 115"). The second swatch was Center for Test Fabrics No. PCS-18 white cotton fabric stained with strawberry juice ("CFT Strawberry"). The third swatch was Center for Test Fabrics No. BC-1 cotton fabric stained with tea for medium/high temperature ("CFT Tea"). The swatches were dipped into solutions containing varying amounts of sodium molybdate in deionized water ("Solution A") and then sprayed with solutions containing varying amounts of 35% active hydrogen peroxide in deionized water ("Solution B"). Unless otherwise indicated below, the sprayed swatches were allowed to stand for 10 minutes. The samples were next rinsed with deionized water and allowed to dry overnight. Stain removal was evaluated using a Hunter ULTRASCAN™ spectrophotometer (Hunter Associates Laboratory). The results are set out below in Table 1.

TABLE 1

| | | | Stain Removal, %[1] | | |
|---|---|---|---|---|---|
| Run No. | Solution A, g/L | Solution B, g/L | EMPA 115 | CFT Strawberry | CFT Tea |
| 1-1 | 237.2 | 190.6 | 21.5 | 36.2 | 63.5 |
| 1-2[2] | 237.2 | 190.6 | 31.4 | 46.2 | 78.5 |
| 1-3 (Control) | 0.0 | 190.6 | 15.2 | 18.4 | 30.9 |
| 1-4 | 186.7 | 150.0 | 24.6 | 37.1 | 68.0 |
| 1-5 (Control) | 0.0 | 150.0 | 16.1 | 18.7 | 36.9 |
| 1-6 | 124.5 | 100.0 | 19.5 | 27.6 | 50.4 |
| 1-7 (Control) | 0.0 | 100.0 | 14.3 | 7.0 | 21.0 |
| 1-8 | 62.2 | 50.0 | 18.5 | 26.3 | 48.8 |
| 1-9 (Control) | 0.0 | 50.0 | 14.7 | 11.5 | 35.2 |
| 1-10 | 31.1 | 25.0 | 16.4 | 13.6 | 32.9 |
| 1-11 (Control) | 0.0 | 25.0 | 13.5 | 1.6 | 18.9 |
| 1-12 | 12.5 | 10.0 | 13.6 | 5.4 | 14.1 |
| 1-13 (Control) | 0.0 | 10.0 | 13.5 | 0.6 | 9.6 |

[1]Stain removal = 100 X (L(washed) − L(unwashed))/(92 − L(unwashed))
[2]15 Minute standing time.

The results in Table 1 show use of the method of the invention to treat a variety of stains at several molybdate and peroxide concentration levels. Improved stain removal was observed for all stains compared to the control methods.

EXAMPLE 2

Stain Removal Using Optional Surfactant Followed by Rinsing Without Wash Cycle Using the method of Example 1, fabric test swatches were soaked or sprayed with a solution of 62.2 g/L sodium molybdate in deionized water ("Solution A"). In some runs noted below, Solution A also contained 5.5 g/L NEODOL™ 25-7 C12–15 primary alcohol ethoxylate ("Solution AE") or 0.01 M sodium lauryl sulfate ("Solution AS"). The swatches were also sprayed with a solution of 50.0 g/L hydrogen peroxide (35% active) in deionized water ("Solution B"). As a control, swatches of the same test fabrics were sprayed with solution B only. The sprayed swatches were allowed to stand for 10 minutes, rinsed with deionized water, allowed to dry overnight and evaluated for stain removal as in Example 1. The manner in which the solutions were applied and the stain removal results are set out below in Table 2.

TABLE 2

| | | Stain Removal, % | | |
|---|---|---|---|---|
| Run No. | Applied Solutions | EMPA 115 | CFT Strawberry | CFT Tea |
| 2-1 (Control) | Spray B only | 14.7 | 11.5 | 35.2 |
| 2-2 | Soak A/Spray B | 18.5 | 26.3 | 48.8 |
| 2-3 | Spray A/Spray B | 14.9 | 15.7 | 32.0 |
| 2-4 | Spray AE/Spray B | 17.0 | 17.5 | 39.9 |
| 2-5 | Spray AS/ Spray B | 15.0 | 16.1 | 33.0 |

The results in Table 2 show the use of the method of the invention to treat a variety of stains by soaking or spraying with a molybdate solution optionally containing a surfactant, followed by spraying with a peroxide solution. Improved stain removal was observed for all EMPA and strawberry stains and for two of the four tea stains compared to the control method.

EXAMPLE 3

Stain Removal Using Varied Drying Times Followed by Rinsing Without Wash Cycle Using the method of Example 1, fabric test swatches were sprayed with Solution AE and then sprayed with Solution B. The sprayed swatches were allowed to stand for 2, 10 or 60 minutes, then rinsed with deionized water, allowed to dry overnight and evaluated for stain removal as in Example 1. The results are set out below in Table 3.

TABLE 3

| | Drying | Stain Removal, %[1] | | |
|---|---|---|---|---|
| Run No. | Time, min | EMPA 115 | CFT Strawberry | CFT Tea |
| 3-1 | 2 | 15.9 | 6.1 | 19.2 |
| 3-2 | 10 | 17.8 | 15.6 | 35.0 |
| 3-3 | 60 | 19.9 | 34.0 | 52.3 |

The results in Table 3 show the use of a variety of drying times in a two-spray system. Longer drying times gave improved stain removal.

EXAMPLE 4

Stain Removal Using Varied Molybdate and Peroxide Concentrations Followed by Rinsing Without Wash Cycle Using the method of Example 1, fabric test swatches were sprayed with Solution AE and then sprayed with solutions containing varying amounts of hydrogen peroxide (35% active). Additional fabric test swatches were sprayed with solutions containing 5.4 g/L NEODOL™ 25-7 surfactant and varying amounts of sodium molybdate and then sprayed with Solution B. The sprayed swatches were allowed to stand, rinsed with deionized water, allowed to stand for another 10 minutes and evaluated for stain removal as in Example 1. The results are set out below in Table 4.

TABLE 4

| Run No. | Molybdate Concentration, g/L | Peroxide (35% Active) Concentration, g/L | Stain Removal, % EMPA 115 | CFT Strawberry | CFT Tea |
|---|---|---|---|---|---|
| 4-1 | 62.2 | 1 | 14.1 | 0 | 2.3 |
| 4-2 | 62.2 | 10 | 14.4 | 3.4 | 10.0 |
| 4-3 | 62.2 | 30 | 16.3 | 9.8 | 19.6 |
| 4-4 | 62.2 | 50 | 17.8 | 15.6 | 35.0 |
| 4-5 | 1 | 25 | 16.2 | 3.3 | 13.5 |
| 4-6 | 5 | 25 | 15.8 | 8.1 | 19.6 |
| 4-7 | 10 | 25 | 18.2 | 13.5 | 24.0 |
| 4-8 | 20 | 25 | 17.4 | 12.3 | 25.7 |
| 4-9 | 31.1 | 25 | 17.4 | 10.4 | 23.8 |
| 4-10 | 45 | 25 | 17.8 | 10.3 | 18.4 |
| 4-11 | 62.2 | 25 | 17.5 | 9.1 | 22.9 |

The results in Table 4 show the use of a variety of concentration levels in a two-spray system.

EXAMPLE 5

Stain Removal Using Varied Molybdate Concentrations Followed by a Wash Cycle Using the method of Example 1, fabric test swatches were sprayed with solutions containing 5.4 g/L M NEODOL™ 25-7 surfactant and varying amounts of sodium molybdate and then sprayed with Solution B. The sprayed swatches were allowed to stand for 10 minutes, then washed in a tergotometer for 30 minutes at 49° C. in 1 L of deionized water containing 1 g of an enzyme-containing built detergent. After drying, stain removal was measured as in Example 1. The results are set out below in Table 5. Run 5—5 employed a dual spray bottle that dispensed both sprays simultaneously.

TABLE 5

| Run No. | Molybdate Concentration, g/L | Peroxide Concentration, g/L | Molar Ratio Na Molybdate/ Hydrogen Peroxide | Stain Removal, % EMPA 115 | CFT Strawberry | CFT Tea |
|---|---|---|---|---|---|---|
| 5-1 (Control) | — | — | — | 20.7 | 8.0 | 12.4 |
| 5-2 (Control) | — | 50.0 | — | 22.9 | 16.5 | 20.2 |
| 5-3 | 62.2 | 50.0 | 1:2 | 26.5 | 37.2 | 48.6 |
| 5-4 | 20.0 | 50.0 | 1:6 | 26.0 | 33.1 | 45.7 |
| 5-5 | 12.4 | 50.0 | 1:10 | 23.8 | 29.9 | 40.3 |
| 5-6 | 10.0 | 50.0 | 1:12 | 24.6 | 31.6 | 43.2 |

The results in Table 5 show that optimal results were obtained at a molybdate/peroxide molar ratio greater than about 1:6, with especially good results being obtained at a 1:2 ratio.

EXAMPLE 6

Stain Removal Versus Color Safety

Using the method of Example 1, fabric test swatches were optionally sprayed with neutral pH solutions containing 10 g/L or 200 g/L sodium molybdate together with 5.4 g/L NEODOL™ 25-7 surfactant, and then sprayed with an aqueous solution containing 50 g/l hydrogen peroxide (35% active, neutral pH) or concentrated hydrogen peroxide (35% active, pH 2.0–2.1). A further swatch was sprayed with a stain remover spray based on chlorine bleach. The sprayed swatches were allowed to stand for 10 minutes, washed in a tergotometer, dried and evaluated using the method of Example 5. The stain removal results are set out below in Table 6.

TABLE 6

| Run No. | First Spray | Second Spray | Stain Removal, % EMPA 115 | CFT Strawberry | CFT Tea |
|---|---|---|---|---|---|
| 6-1 (Control) | — | 50 g/L $H_2O_2$ (35% Active) | 22.9 | 16.5 | 27.6 |
| 6-2 | 10 g/L molybdate | 50 g/L $H_2O_2$ (35% Active) | 24.6 | 31.6 | 51.5 |
| 6-3 (Control) | — | Concentrated $H_2O_2$ | 27.1 | 38.9 | 57.7 |
| 6-4 | 200 g/L molybdate | Concentrated $H_2O_2$ | 61.4 | 90.2 | 103.8 |
| 6-5 (Control) | Chlorine Bleach | — | 92.1 | 96.7 | 100.1 |

A color-safety test was performed according to ASTM D 5548–99. Cotton fabric swatches were dyed with a 1.5% solution of Direct Blue 1. Excess dye was removed by rinsing. In five runs identified as 7-1 through 7-5, the dyed blue swatches were treated with the same sprays used in Run Nos. 6-1 through 6-5 and allowed to stand for another 10 minutes as described above. The thus-treated swatches were washed in the tergotometer for 40 minutes at 49° C. in 1 L of deionized water containing 1 g of an enzyme-containing built detergent. The swatches were rinsed in deionized water, dried without heat, and evaluated using the Hunter ULTRASCAN spectrophotometer. The spray/dry/wash/dry cycles were repeated two more times to provide color loss monitoring over a total of three wash cycles.

The color loss after three wash cycles was determined by measuring ΔE values for all conditions and normalizing the ΔE values to the Run No. 6-1 and 6-5 controls. In other words the ΔE value for Run No. 6-1 was deemed to be 0% and the chlorine bleach ΔE value (Run No. 6-5) was deemed to be 100%. The ΔE values were calculated using the L, b and a color values measured by the spectrophotometer after three wash cycles and comparing them to the $L_0$, $b_0$, and $a_0$ color values measured before the three wash cycles, using the equation:

$$\Delta E = \text{Square root of } (L-L_0)^2+(b-b_0)^2+(a-a_0)^2$$

The results are set out below in Table 7.

TABLE 7

| Run No. | ΔE | Normalized % Color Loss |
|---|---|---|
| 7-1 (Control) | 5.0 | 0 |
| 7-2 | 5.4 | 1.2 |
| 7-3 (Control) | 6.0 | 3.0 |
| 7-4 | 18.3 | 38.6 |
| 7-5 (Control) | 39.4 | 100.0 |

The results in Tables 6 and 7 show when sufficient amounts of molybdate and peroxide were applied using a prespotting method, stain removal comparable to that obtained using chlorine bleach spray could be obtained but with much lower color loss. A method employing a first solution containing at least about 200 g/L sodium molybdate in 5.4 g/L aqueous surfactant solution and a second solution containing about 35% hydrogen peroxide in water provided especially good results.

COMPARISON EXAMPLE

Using the general method of Japanese Patent Application No. 6-41593, 0.18 wt. % sodium percarbonate and varying amounts ranging from 0 wt. % up to 2 wt. % of sodium molybdate were added to a 1 L tergotometer or to a 45 L washing machine and evaluated using the Example 1 test fabrics. The presence or absence of sodium molybdate did not appear to cause an improvement in bleaching performance. This is believed to be due to the very short half-life of singlet oxygen and the likelihood that whatever singlet oxygen may have been generated decayed before it could bleach the test fabrics.

Various modifications and alterations of this invention will be apparent to those skilled in the art without departing from the scope and spirit of the invention, and are intended to be within the scope of the following claims.

The invention claimed is:

1. A cleaning method comprising applying primarily to a stained region of a washable soft substrate, at a greater add-on weight than to at least one unstained region, a composition that contains at least one salt of molybdic acid or a compound or compounds that release a salt of molybdic acid in aqueous solution, and which can generate singlet oxygen in situ in the presence of a peroxide, optionally applying to the substrate a prespotting composition that contains at least one peroxide, and rinsing, laundering or otherwise cleaning the substrate, using a peroxygen-containing built detergent to clean the substrate if a prespotting composition containing peroxide has not been applied to the substrate.

2. A method according to claim 1 comprising applying to the substrate a single prespotting composition that contains at least one molybdate and at least one peroxide.

3. A method according to claim 1 comprising applying to the substrate a first prespotting composition that contains at least one molybdate and a second prespotting composition that contains at least one peroxide.

4. A method according to claim 3 wherein the first and second prespotting compositions comprise aqueous solutions.

5. A method according to claim 3 wherein the substrate is soaked in the first prespotting composition and the second prespotting composition is sprayed onto the substrate.

6. A method according to claim 1 wherein the molybdate comprises sodium, potassium or ammonium molybdate.

7. A method according to claim 1 wherein the peroxide comprises hydrogen peroxide.

8. A method according to claim 1 further comprising applying a surfactant to the substrate.

9. A method according to claim 8 wherein the surfactant comprises a linear alkyl ethoxylate.

10. A method according to claim 8 comprising applying about 0.1 wt. % to about 5 wt. % surfactant based on the weight of the composition.

11. A method according to claim 1 comprising applying a prespotting composition containing about 1 wt. % to about 30 wt. % molybdate.

12. A method according to claim 1 comprising applying a prespotting composition containing about 1 wt. % to about 35 wt. % peroxide.

13. A method according to claim 1 comprising applying molybdate and peroxide in a molar ratio of about 2:1 to about 1:35.

14. A method according to claim 1 wherein the substrate comprises a fabric, knit, nonwoven, carpet, leather, felt or microporous film.

15. A method according to claim 1 wherein the prespotting composition that contains at least one molybdate is permitted to remain on the substrate for about 1 minute to about 60 minutes.

16. A method according to claim 15 wherein the prespotting composition that contains at least one molybdate is rinsed from the substrate.

17. A method according to claim 15 wherein the prespotting composition that contains at least one molybdate is laundered from the substrate.

18. A prespotting kit comprising a first solution comprising at least one molybdate, a second solution comprising at least one peroxide and instructions for applying the first and second solutions primarily to a stained region of a washable soft substrate.

19. A prespotting kit according to claim 18 wherein the first and second solutions are aqueous solutions.

20. A prespotting kit according to claim 18 wherein the molybdate comprises sodium, potassium or ammonium molybdate.

21. A prespotting kit according to claim 18 wherein the peroxide comprises hydrogen peroxide.

22. A prespotting kit according to claim 18 wherein the first solution comprises about 1 wt. % to about 30 wt. % molybdate.

23. A prespotting kit according to claim 18 wherein the second solution comprises about 1 wt. % to about 35 wt. % peroxide.

24. A prespotting kit according to claim 18 comprising molybdate and peroxide in a molar ratio of about 2:1 to about 1:35.

25. A treated article comprising a washable soft substrate having a stained region, the stained region having absorbed thereon to a greater extent in the stained region than in at least one unstained region an aqueous singlet oxygen-generating mixture comprising peroxide and more than 0.1 wt. % salt of molybdic acid or a compound or compounds that release a salt of molybdic acid in aqueous solution.

26. A treated article according to claim 25 wherein the peroxide comprises hydrogen peroxide.

27. A treated article according to claim 25 wherein the molybdate comprises sodium, potassium or ammonium molybdate.

28. A treated article according to claim 25 comprising molybdate and peroxide in a molar ratio of about 2:1 to about 1:35.

* * * * *